United States Patent [19]

Guirguis

[11] Patent Number: 4,897,995

[45] **Date of Patent: * Feb. 6, 1990**

[54] LIQUID TURBOJET ENGINE

[76] Inventor: Raafat H. Guirguis, 5516 Starboard Ct., Fairfax, Va. 22032

[ * ] Notice: The portion of the term of this patent subsequent to Mar. 3, 2004 has been disclaimed.

[21] Appl. No.: 161,156

[22] Filed: Feb. 26, 1988

[51] Int. Cl.[4] ..... B63H 11/00; F02C 3/30

[52] U.S. Cl. ..... 60/221; 60/39.35; 60/39.57; 440/45; 123/19

[58] Field of Search ..... 60/221, 222, 39.57, 60/39.53, 39.56, 39.34, 39.35, 39.465; 440/47, 45; 123/19

[56] References Cited

U.S. PATENT DOCUMENTS

| | | | |
|---|---|---|---|
| 965,985 | 8/1910 | Brockhausen . | |
| 1,094,919 | 4/1914 | Nash . | |
| 1,206,001 | 11/1916 | Kuhl . | |
| 1,337,323 | 4/1920 | Ostenberg . | |
| 1,677,198 | 7/1928 | Naileigh . | |
| 1,853,869 | 4/1932 | Marks . | |
| 2,469,678 | 5/1949 | Wyman . | |
| 2,865,172 | 12/1958 | Bodde . | |
| 3,271,947 | 9/1966 | Kemenczky | 60/221 |
| 3,288,100 | 11/1966 | Cox et al. | 60/222 |
| 3,354,648 | 11/1967 | Asahina | 60/221 |
| 3,365,891 | 1/1968 | Williams | 440/45 |
| 3,575,127 | 4/1971 | Wislicenus | 60/222 |
| 3,581,503 | 6/1971 | Bernd | 60/221 |
| 3,643,438 | 2/1972 | Barsby | 440/45 |
| 3,678,689 | 7/1972 | Ishiwata | 60/221 |
| 3,872,665 | 3/1975 | Jarry | 60/221 |
| 3,990,228 | 11/1976 | Bailey . | |
| 4,031,697 | 6/1977 | Adair . | |
| 4,304,095 | 12/1981 | Rasamen . | |
| 4,646,515 | 3/1987 | Guirguis | 60/39.57 |

FOREIGN PATENT DOCUMENTS 315191 3/1917 Fed. Rep. of Germany .

*Primary Examiner*—Donald E. Stout

*Attorney, Agent, or Firm*—Roylance, Abrams, Berdo & Goodman

[57] ABSTRACT

A liquid turbojet engine includes an elongated shaft, a housing mounted about the shaft with the shaft being rotatable relative to the housing about the shaft longitudinal axis, a conduit fixed to the shaft within the housing filled with an inert motive liquid and nozzles for inducing combustible gas bubbles in the motive liquid. The conduit has a compression section extending generally radially from the shaft, a combustion section extending generally axially and parallel to the shaft and from the compression section at a radial distance from the shaft, and an expansion section extending generally radially relative to the shaft axis from an end of the combustion section remote from the compression section. The bubble nozzles are located at the inlet of the compression section. The motive liquid enters through an inlet in the housing. The burned bubbles are discharged with the motive liquid through an exit nozzle in the housing.

21 Claims, 2 Drawing Sheets

LIQUID TURBOJET ENGINE

FIELD OF THE INVENTION

The present invention relates to an engine employing liquid as a motive fluid wherein combustible gas bubbles are induced into the liquid, compressed and then ignited. Expansion of the bubbles subsequent to ignition drives the motive fluid which drives the engine. The engine allows the gas in the bubbles to go through a complete thermodynamic cycle. The engine can propel marine vehicles by rotating a propeller or by discharging the motive liquid at high speed, or can generate a high speed jet of water for cutting into sandy hills, extinguishing fires, and the like.

BACKGROUND OF THE INVENTION

A conventional gas turbine supplies both water and an explosive mixture to the interior of a housing. The explosive mixture is then ignited forcing the water and exhaust gases along a bell shape member, through an opening and against a set of blades causing rotation of a shaft. Such arrangement is disclosed in U.S. Pat. No. 1,206,001 to Kuhl.

Another liquid and gas turbine is disclosed in U.S. Pat. No. 965,985 to Brockhausen. This turbine combines the explosive power of a gas with water to generate power. Bubbles of the gas are formed in the water and are then ignited adjacent a water wheel to rotate the water wheel.

These conventional devices are not properly classified as engines since they do not permit the gas to go through a thermodynamic cycle, and thus, cannot produce work on a continuous basis. Additionally, no practical systems are provided to ignite bubbles moving in the motive liquid.

The present invention is similar in concept and construction to the two phase engine disclosed in U.S. Pat. No. 4,646,515 to Guirguis, the subject matter of which patent is hereby incorporated by reference. The engine of the present invention is modified to adapt such engine for propelling marine vehicles or generating a high speed jet of water.

SUMMARY OF THE INVENTION

An object of the present invention is to provide a turbojet engine which operates under water to propel a marine vehicle.

Another object of the present invention is to provide an engine which produces a high speed liquid jet.

A further object of the present invention is to provide an engine for propelling a marine vehicle or producing a high speed liquid jet which can achieve a high level of power output, is smaller than conventional engines, has virtually no wearing components or oil consumption, does not need separate cooling, and is simpler and less expensive to manufacture and maintain.

A still further object of the present invention is to provide an engine for propelling a marine vehicle or producing a high speed liquid jet which operates at high efficiency, produces less pollutants than conventional engines, and can run with different fuels and at different fuel-to-air ratios for each of the various fuels.

The foregoing objects are obtained by an engine comprising an elongated shaft, a housing mounted about the shaft with the shaft rotatable relative to the housing about the shaft longitudinal axis, a conduit within the housing and fixed to the shaft, and bubble means. The conduit has a compression section extending generally radially from the shaft, a combustion section extending generally axially and parallel to the shaft and from the compression section at a radial distance from the shaft, and an expansion section extending from the end of the combustion section remote from the compression section. Inlet means extends through the housing for receiving relatively inert motive liquid from outside the housing and conveying the motive liquid to the conduit to fill the conduit with the motive liquid. The bubble means is located adjacent an inlet of the compression section and induces bubbles of combustible gas into the motive liquid in the combustion section.

In this manner, the gas bubbles are compressed as they move through the compression section, and are ignited in the combustion section. The ignited bubbles and the compressed motive liquid then pass through the expansion section where the bubbles expand in a manner to produce usable power.

By forming the combustion chamber as a gas bubble in a motive liquid, such as water, and by using centrifugal forces to achieve both compression and expansion, the efficiency of the engine is increased, while reducing the production of pollutants. The forces generated by the expanding bubbles are transmitted directly to the liquid. This eliminates the use of sliding parts providing a more efficient transmission of energy. Mechanical friction is negligible. The hydrodynamic losses are small since the motive liquid is essentially incompressible and since compression is achieved by body forces.

Preferably, the shaft rotates while the housing is fixed. An impeller can define the conduit and can be fixedly mounted on the shaft for simultaneous rotation within the fixed housing. Angularly offset blades at the exit of the conduit can be used to produce torque on the shaft. Alternatively, the motive liquid can exit at a high velocity due to expansion of the bubbles to produce thrust or a liquid jet stream.

Other object, advantages and salient features of the present invention will become apparent from the following detailed description which, taken in conjunction with the annex drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
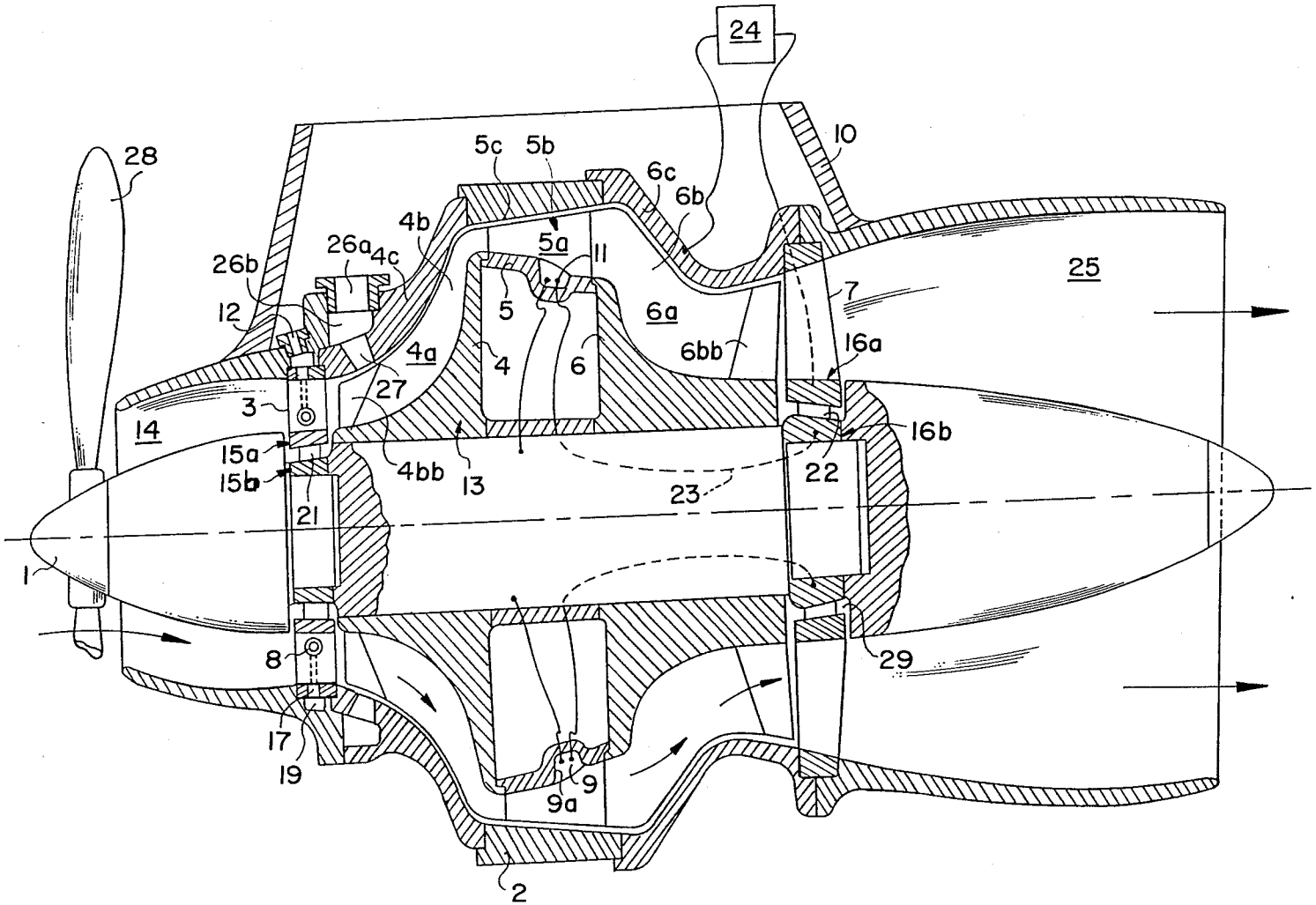
FIG. 1 is a side elevational view in partial section of an engine according to a first embodiment of the present invention.

Referring initially to FIG. 1, the engine of the present invention comprises a relatively stationary housing 2 and a rotatable shaft 1. A rotor 13 is fixedly mounted on the shaft for simultaneous rotation with the shaft about the longitudinal axis of the shaft and relative to housing 2. Housing 2, rotor 13, and shaft 1 define a conduit. The conduit is filled with and conveys an inert motive liquid and combustible gas bubbles. The combustible gas bubbles are compressed, ignited, and then expanded with the liquid. The bubbles' expansion drives the liquid at a higher velocity through the angularly offset conduit exit producing rotation of the rotor and shaft in the housing.

Housing 2 comprises a plurality of parts that are fixedly secured together. The housing can be mounted on a support 10 maintaining the housing relatively fixed or stationary and receiving liquid, electric, and gas lines necessary for the starting, operating, and controlling the engine. If the engine is used to propel a marine vehicle, support 10 is attached to the structure of the vessel. By enclosing all fuel and electric lines in support 10, its cross section is designed to reduce the drag on the housing 2 and support 10.

Stationary inlet blades 3 and stationary exit blades 7 guide the motive liquid to smoothly enter through inlet 14 and exit through nozzle 25. They also serve several important functions. Inlet blades 3 and exit blades 7 are fixed to housing 2 and circumscribe shaft 1. Their central annulii 15*a* and 16*a* provide radial and axial support for bearings 21 and 22. Bearings 21 and 22 allow shaft 1 to rotate freely relative to housing 2, but define the axial location of shaft 1 and in turn rotor 13, in relation to housing 2.

Figure 2:
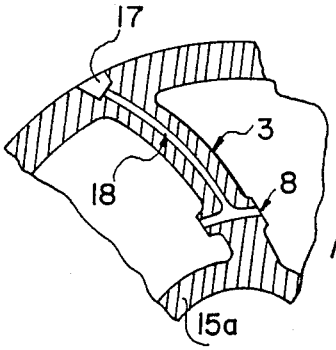
FIG. 2 is an enlarged partial side elevational view in section of an inlet blade of the engine of FIG. 1.

Inlet blades 3 also provide a means for inducing the combustible gas into the liquid stream. A cross sectional view of one of the inlet blades 3 is presented in FIG. 2. Each blade has an intake port 17 through which the combustible gas (such as fuel and air mixtures) passes, then flows through narrow conduit 18, and eventually exits through side holes 8. As the motive liquid flows between blades 3, the gases exiting through holes or nozzles 8 form bubbles that are entrained in the motive liquid stream. As illustrated in FIG. 1, intake ports 17 communicate with a main gas supply valve 12 through annular groove 19. Valve 12 controls the rate of gas induced in the motive liquid stream, and thereby, the engine thrust. Supply valve 12 is coupled to a gas supply conduit extending through support 10.

Rotor 13 comprises a front impeller 4 and a rear impeller 6. The impellers are arranged back-to-back and are rigidly or fixedly connected by a generally annular combustion ring 5. Impeller 4 has radially extending pump blades 4*b*, while rear impeller 6 has radially extending turbine blades 6*b*. Combustion ring 5 has radially extending blades 5*b*. Blades 4*b*, 5*b*, and 6*b* are axially aligned in sets, with the various sets being circumferentially spaced about rotor 13. This divides the fluid conduit between the rotor and housing into a plurality of circumferentially spaced sections.

Blades 4*b* and 6*b* are curved in the radial direction such that the centrifugal force resulting from their curvature balances the Coriolis component of the acceleration. If the Coriolis component is not balanced, the buoyancy forces will push the bubbles toward the blades. Instead of moving near the center of the conduit, the bubbles in a radially straight conduit will drag along the walls of the conduit, which would require a higher liquid velocity to carry them against the buoyancy forces in compression section 4*a*, and would reduce the acceleration of the motive liquid in expansion section 6*a*.

Each circumferential section of the fluid conduit is divided into three sections. A compression section 4*a*, a combustion section 5*a*, and an expansion section 6*a*. Compression section 4*a* is tapered radially outwardly, i.e., reduces in height between the front impeller and the adjacent housing portion 4*c*. This tapering accelerates the motive liquid flow, thus enhancing the liquid's ability to carry bubbles into combustion section 5*a* against the buoyancy forces in compression section 4*a*.

Combustion ring 5 extends generally rearwardly and radially inwardly relative to the shaft longitudinal axis such that buoyancy forces prevent bubbles that have passed into combustion section 5*a* from trickling back in compression section 4*a*. Similarly, the inner surface of the adjacent housing portion 5*c* extends rearwardly and radially outwardly. In this manner, combustion ring 5 and housing portion 5*c* define the radially inward and radially outward, respectively, peripheries of combustion section 5*a* such that combustion section 5*a* tapers toward compression section 4*a*.

Expansion section 6*a* extends rearwardly and radially inwardly from combustion section 5*a*. The shape of rear impeller 6 and the adjacent housing portion 6*c* define expansion section 6*a* such that it tapers in a direction toward combustion section 5*a*. The motive liquid exits through angularly offset blades 6*bb* which are integral parts of blades 6*b* extending from impeller 6. From blades 6*bb*, the motive liquid passes between stationary blades 7 and into the nozzle 25.

Combustion ring 5 has an intermediate recess 9. Recess 9 is generally annular, extends radially inwardly and opens in a radially outward direction. The upstream end of recess 9 is defined by a radially outwardly extending step 9*a*. Step 9*a* creates a recirculation zone downstream of the step which assists in sustaining bubble combustion. Combustion blades 5*b* do not extend into recess 9, permitting communication between the circumferentially arranged conduits through recess 9. this communication equalizes the pressure at recess 9 between all the circumferentially arranged conduits sections. Thereby, the pressure at similar locations but in different circumferential conduit sections is also equalized to some extent throughout sections 4*a*, 5*a*, and 6*a*. This equalization balances the pressure forces on the shaft and housing. It also equalizes the torque and power produced in all conduit sections for smooth operation.

Figure 3:
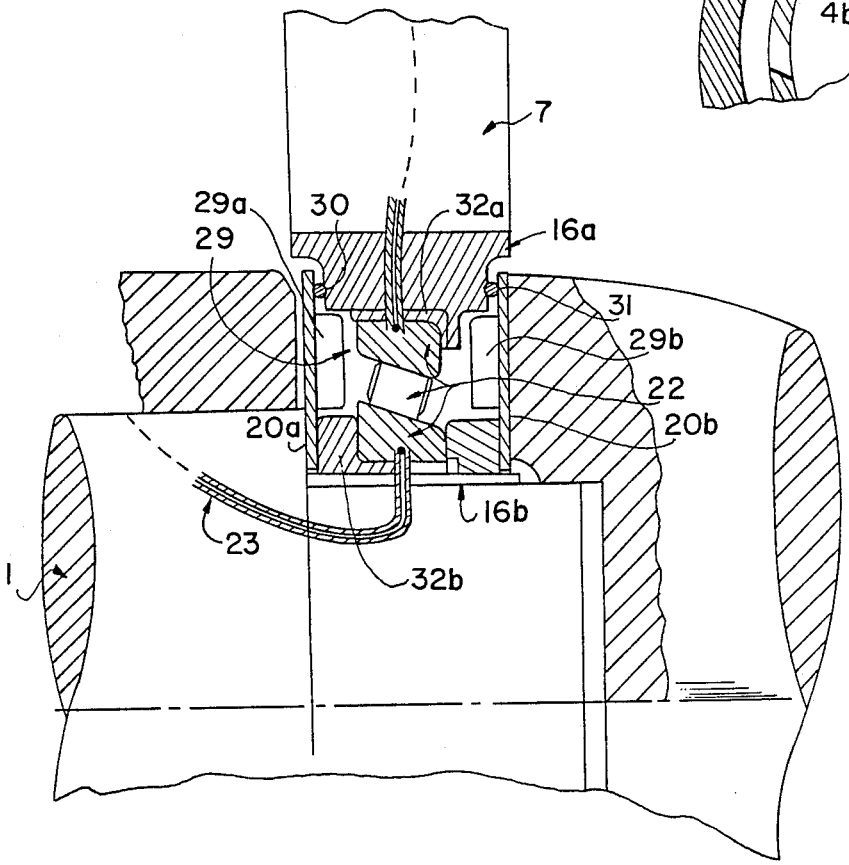
FIG. 3 is an enlarged, partial side elevational view in section of an exit blade of the engine of FIG. 1.

A spark initiator 11 is located in recess 9 in each combustion section 5*a*. The positive end of spark initiators 11 are connected to the positive end of high voltage source 24 by wires 23 extending through, but insulated from, shaft 1 and annulus 16*b*, through bearing 22, and again by wires extending through but insulated from annulus 16*a*, blades 7, and housing 2, as illustrated in FIG. 3. All other parts of the engine are considered ground connection, and are connected to the negative end of voltage source 24 through shaft 1, annulus 15*b*, bearing 21, annulus 15*a*, blades 3, and housing 2, as shown in FIG. 1.

An enlarged view of compartment or chamber 29 enclosing bearing 22 is also shown in FIG. 3. Compartment 29 is suitably closed with seals 30 and 31 permitting rotation of shaft 1 relative to blades 7, while preventing the motive liquid from entering the compartment. Two small discs 20*a* and 20*b* with integrated small radial vanes 29*a* and 29*b* are fixedly secured to and rotate with shaft 1. If any liquid leaks through seals 30 and 31, and tends to flow inwardly through vanes 29*a* or 29*b*, centrifugal forces will repel it out again. Bearing 22 is insulated from all the surrounding grounded metal by rings 32*a* and 32*b*, made from a rigid insulation material.

In operation, the space between housing 2 on one side and shaft 1 and rotor 13 on the other side is filled with an inert motive liquid, such as water. A combustible gas is conveyed through valve 12, groove 19, inlet ports 17, passageways 18, and out holes or nozzles 8 producing combustible gas bubbles at the inlet of compressions section 4*a*. Since rotor 13 including impellers 4, 5, and 6 and blades 4*b*, 5*b* and 6*b* rotate together with shaft 1, the pressure of the motive liquid in the compression section increases in a radially outward direction. As the bubbles are conveyed radially outwardly through the increasingly higher pressurized liquid, they are compressed and are made smaller as they move in the direction of combustion section 5*a*.

Figure 4:
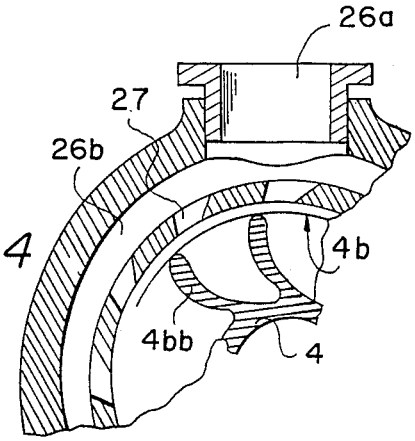
FIG. 4 is an enlarged, partial front elevational view of the forward portion of the impeller of the engine of FIG. 1.

During the starting operation, high pressure liquid is introduced through valve 26*a* communicating to angularly offset nozzles 27 through annular groove 26*b*. Nozzles 27 circumscribe angularly offset and radially curved blades 4*bb* which are integral parts of blades 4*b* extending from impeller 4, as illustrated in FIG. 4. The high pressure liquid produced by a pump driven by a separate motor, causes a jet of liquid to emerge from each of the nozzles 27. Curved blades 4*bb* act as a radial turbine and rotate under the action of these jets. The rotation of shaft 1 and rotor 13 initiates the flow of liquid through the liquid conduit. This is because the liquid exits the rotor at a larger radius than at the inlet.

Figure 5:
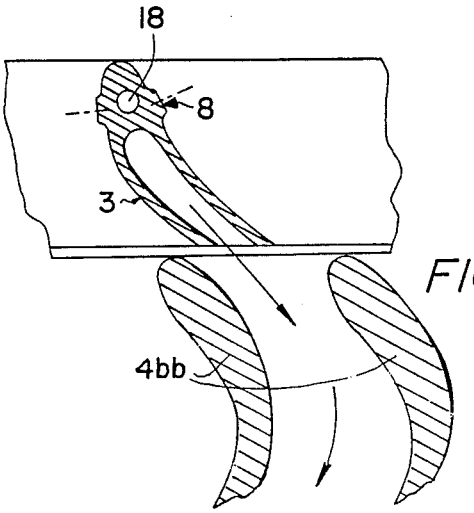
FIG. 5 is an enlarged, partial sectional view of an engine according to a second embodiment of the present invention.
Figure 6:
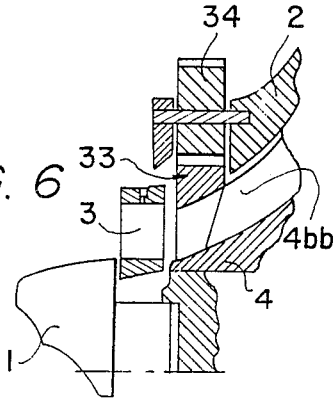
FIG. 6 is an enlarged, partial sectional view of an engine according to a third embodiment of the present invention.

Although other methods can be used to start rotation of shaft 1, using jets of the motive liquid acting on blades 4*bb* shaped as radial turbine blades is preferred because it can produce a large torque on rotor 13 from relatively small size blades. In addition, this type of construction does not require any sealing, as would a construction based on a mechanical link between rotor 13 or shaft 1 and some power source outside housing 2. FIGS. 5 and 6 describe two other methods to start the engine.

In the embodiment illustrated in FIG. 5, liquid is pumped at high pressure through inlet blades 3. Blades 4*bb* act then as an impulse axial turbine. In this case, a large volume of liquid has to be pumped through blades 3 to provide enough torque to start the engine.

In FIG. 6, an annular rim 33, is formed as an integral part of blades 4*bb*. The outer surface of this rim is shaped into a gear constantly engaged to pinion gear 34, thus providing a mechanical link through housing 2. Locating gear 34 at the inlet of the conduit eliminates, some but not all, the problems of sealing the motive liquid conduit, by locating the required seals at the point of lowest pressure common to both the housing and the liquid conduit.

After the flow of liquid is initiated in the rotor, gas bubbles flowing in the combustion section will tend to accumulate in recess 9, due to the large buoyancy forces directing the bubbles radially inwardly. The accumulation of gas bubbles in recess 9 will displace all of the liquid out of the recess until the recess is completely filled with combustible gas. After the recess is filled with combustible gas, additional bubbles will continue to flow through the conduit. A spark from spark initiator 11 will cause burning of the gas in recess 9 in a manner sufficient to start the combustion process. Once a combustion process is initiated, it is self sustaining. The self sustaining bubble ignition occurs in one of two ways, or a combination of the two ways. The first way involves pressure waves generated when the bubbles ignite and travel locally in all directions igniting incoming gas bubbles. The shape of the combustion section and the compression section does not totally prevent the pressure waves from propagating upstream into the compression section. However, the shape substantially weakens these pressure waves such that they cannot ignite the bubbles in compression section 4*a*. This particularly results from the divergency of the compression section toward its inlet and the centrifugal acceleration against which the waves have to propagate.

The second mechanism for the continuous combustion of the gas bubbles is the transfer of the hot products from one burned bubble to an adjacent unburned bubble. The transfer process is accomplished by small bubbles being ejected from a burned parent bubble. This transfer of the hot products from the burned bubbles to the unburned bubbles to ignite the unburned bubbles is enhanced by the recirculation created in the combustion zone downstream of step 9*a*, causing the burned and unburned bubbles to be relocated closer to each other. The recirculation increases the chances of the small ejected bubbles reaching the unburned bubbles.

As the burned bubbles expand, the motive liquid is accelerated in expansion section 6*a*. The high velocity liquid passing through angularly offset blades 6*bb* provides the necessary torque to cause the rotation of the engine. The burned bubbles are discharged with the liquid stream exiting the engine through nozzle 25.

The engine thrust can be obtained in one or a combination of two ways. The angular offset of blades 6*bb* can be made large enough to derive the whole engine power as net torque on shaft 1 which can be then coupled to a propeller 278 that produces the net thrust. Propeller 28 can also be mounted on the rear end of shaft 1. It is preferable however to mount it on the foreward part of the shaft where the propeller blades do not come in contact with the exhaust gases exiting with the stream of liquid, because the exhaust gases and water vapor in the bubbles can cause pitting of the propeller blades.

Alternatively, blades 6*bb* can be angularly offset just enough to produce the torque necessary to overcome the friction resisting the rotation of shaft 1, in which case the net increase in the kinetic energy of the liquid exiting the engine through nozzle 25 relative to the kinetic energy at inlet 14 causes a net thrust on the engine, or can be used directly as a high speed liquid jet. A combination of both a propeller and a high speed jet can also be used to produce thrust on the engine.

While particular embodiments have been chosen to illustrate the invention, it will be understood by those skilled in the art that various changes and modifications can be made therein without departing from the scope of the invention as defined in the appended claims.

What is claimed is:

1. An engine, comprising:

an elongated shaft extending along a longitudinal axis;

a housing mounted about said shaft, said shaft being rotatable relative to said housing about said longitudinal axis;

a conduit, within said housing and fixed to said shaft, having a compression section extending generally radially from said shaft, a combustion section extending generally axially and parallel relative to said shaft and from said compression section at a radial distance from said shaft and an expansion section extending from an end of said combustion section remote from said compression section;

inlet means, extending through said housing, for receiving relatively inert motive liquid from outside said housing and conveying said motive liquid to said conduit to fill said conduit with said relatively inert motive liquid; and bubble means, adjacent an inlet end of said compression section, for inducing bubbles of combustible gas into said motive liquid in said compression section;

whereby the combustion gas bubbles are compressed during movement through said compression section, are ignited in said combustion section, and pass through said expansion section with said motive liquid.

2. An engine according to claim 1 wherein said housing comprises exhaust means for discharging said motive fluid and exhaust products conveyed from said expansion section.

3. An engine according to claim 1 wherein said bubble means comprises a combustible gas passage extending through and into said housing.

4. An engine according to claim 1 wherein said hosing comprises inlet blades fixed to said housing and rotatably supporting said shaft, said combustible gas passage extending through said inlet blades and terminating into exit nozzles at said inlet end of said compression section.

5. An engine according to claim 3 wherein said housing comprises valve means for regulating combustible gas flow.

6. An engine according to claim 1 wherein said housing comprises exit blades fixed to said housing at outer ends thereof adjacent said expansion section, and having bearing means at inner ends thereof rotatably supporting said shaft.

7. An engine according to claim 6 wherein said combustion section comprises a radially inwardly extending start recess, said recess being generally annular and opening radially outwardly.

8. An engine according to claim 7 wherein said combustion section comprises ignition means for generating sparks in said start recess.

9. An engine according to claim 8 wherein said ignition means is coupled to an electrical power source by a power line extending through said exit blades, said bearing means and said shaft.

10. An engine according to claim 9 wherein said bearing means are located in a chamber in said shaft with sealing means for inhibiting entrance of said motive liquid into said chamber.

11. An engine according to claim 10 wherein said chamber comprises radial pump means for discharging any motive liquid leaking into said chamber.

12. An engine according to claim 1 wherein said housing comprises jet means, adjacent said inlet end of said compression section, for emitting motive liquid; and said shaft comprises inlet blades angled and positioned on said shaft to receive motive liquid emitted by said jet means, causing said shaft to rotate relative to said housing.

13. An engine according to claim 1 wherein said shaft has a propeller on a forward end thereof.

14. An engine according to claim 1 wherein said expansion section extends generally radially relative to said longitudinal axis.

15. An engine according to claim 1 wherein said expansion section, fixed to said shaft for simultaneous rotation therewith, ends in angularly offset blades.

16. An engine according to claim 1 wherein said compression section tapers in a radially outward direction.

17. An engine according to claim 1 wherein said combustion section tapers toward said compression section.

18. An engine according to claim 1 wherein said expansion section tapers toward said combustion section.

19. An engine according to claim 1 wherein said conduit is defined in a radially outward direction by said housing and is defined in a radially inward direction by impellers fixed to said shaft.

20. An engine according to claim 19 wherein said conduit is divided into a plurality of circumferentially spaced sections separated by radial blades extending axially relative to said longitudinal axis.

21. An engine according to claim 1 wherein inlet blades are fixed at outer ends thereof to said housing adjacent said inlet end of said compressions section; and exit blades are fixed at outer ends thereof to said housing adjacent said expansion section, inner ends of said inlet blades and said exit blades having bearing means for rotatably supporting said shaft.

* * * * *